US011231234B2

(12) United States Patent
Lin et al.

(10) Patent No.: US 11,231,234 B2
(45) Date of Patent: Jan. 25, 2022

(54) ACOUSTIC PANEL WITH VAPOR CHAMBERS

(71) Applicant: Toyota Motor Engineering & Manufacturing North America, Inc., Plano, TX (US)

(72) Inventors: Yeongching Lin, Ann Arbor, MI (US); Tai-Yun Huang, Ann Arbor, MI (US); Takumi J. Jinmon, Ann Arbor, MI (US); Takayuki Sugiyama, Ann Arbor, MI (US); Gaohua Zhu, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 588 days.

(21) Appl. No.: 16/172,107

(22) Filed: Oct. 26, 2018

(65) Prior Publication Data

US 2020/0132389 A1 Apr. 30, 2020

(51) Int. Cl.
*F28D 15/02* (2006.01)
*G10K 11/162* (2006.01)

(52) U.S. Cl.
CPC ..... *F28D 15/0275* (2013.01); *G10K 11/162* (2013.01)

(58) Field of Classification Search
CPC ..... G10K 11/162; F28D 15/0275
USPC ..... 181/288
See application file for complete search history.

(56) References Cited

U.S. PATENT DOCUMENTS

| | | | | |
|---|---|---|---|---|
| 5,445,861 | A | 8/1995 | Newton et al. | |
| 6,290,022 | B1 | 9/2001 | Wolf et al. | |
| 8,820,477 | B1 | 9/2014 | Herrera et al. | |
| 10,099,317 | B2 * | 10/2018 | Hakuta | E04B 1/86 |
| 2003/0006090 | A1 | 1/2003 | Reed | |
| 2006/0257621 | A1 | 11/2006 | Kuriyama | |
| 2012/0240486 | A1 | 9/2012 | Borroni | |
| 2014/0110188 | A1 * | 4/2014 | Ichihashi | G10K 11/172 181/292 |
| 2015/0122577 | A1 | 5/2015 | Zalewski et al. | |
| 2016/0017810 | A1 | 1/2016 | Lord et al. | |
| 2016/0027427 | A1 | 1/2016 | Yang et al. | |
| 2016/0078857 | A1 | 3/2016 | Sheng et al. | |
| 2017/0053635 | A1 | 2/2017 | Leon et al. | |
| 2017/0089238 | A1 * | 3/2017 | Leyko | B33Y 10/00 |
| 2018/0051462 | A1 | 2/2018 | Hakuta et al. | |
| 2018/0100708 | A1 * | 4/2018 | Hsieh | F28D 15/046 |
| 2018/0106552 | A1 * | 4/2018 | Lin | H05K 7/20336 |

(Continued)

FOREIGN PATENT DOCUMENTS

WO 2016102691 A2 6/2016

OTHER PUBLICATIONS

Ma et al., "Acoustic metasurface with hybrid resonances," Nature Materials (2014).

(Continued)

*Primary Examiner* — Forrest M Phillips
(74) *Attorney, Agent, or Firm* — Christopher G. Darrow; Darrow Mustafa PC

(57) ABSTRACT

An acoustic unit includes an acoustically septumized cell, and a vapor chamber attached across the cell. The vapor chamber is configured to employ vapor-liquid phase changing to help move heat past the cell.

19 Claims, 3 Drawing Sheets

(56) References Cited

U.S. PATENT DOCUMENTS

2018/0356158 A1* 12/2018 Kusuda ..... F28D 15/04

OTHER PUBLICATIONS

Huang, "Vibration of Thin Plates under Acoustic Excitations: its Application in Acoustic Metamaterials," North Carolina State University (2017).

* cited by examiner

ACOUSTIC PANEL WITH VAPOR CHAMBERS

TECHNICAL FIELD

The embodiments disclosed herein relate to acoustic panels and, more particularly, to acoustic panels in which transversely-oriented acoustic elements are used to attenuate the movement of frontal acoustic excitation behind the acoustic panels.

BACKGROUND

Acoustics and, more particularly, acoustic panels that attenuate the movement of frontal acoustic excitation behind the acoustic panels, have long been a focus of engineering design. Some acoustic panels include a cellular acoustic unit layer that features acoustic units. In these acoustic panels, the acoustic units include acoustically septumized cells. Using the acoustic septa and other acoustic elements, if any, attached across the cells, the acoustic unit layer is configured to attenuate the movement of frontal acoustic excitation past the acoustic unit layer.

SUMMARY

Disclosed herein are embodiments of acoustic panels and acoustic units for acoustic panels that include vapor chambers. In one aspect, an acoustic unit includes an acoustically septumized cell, and a vapor chamber attached across the cell. The vapor chamber is configured to employ vapor-liquid phase changing to help move heat past the cell.

In another aspect, an acoustic panel includes a cellular panel that forms cells, an acoustic unit whose construction is based on a cell, and a vapor chamber attached across a cell. The acoustic unit includes the cell and an acoustic element attached across the cell, whereby the acoustic unit is configured to attenuate the movement of frontal acoustic excitation using the acoustic element. The acoustic unit is made at least partially from a thermally nonconductive material. The vapor chamber has a body with an exterior heat absorption face and an opposing exterior heat dissipation face. The vapor chamber is configured to help move heat past the cell by absorbing heat at the heat absorption face, employing vapor-liquid phase changing to effectively thermally conduct absorbed heat through the body to the heat dissipation face, and dissipating effectively thermally conducted heat at the heat dissipation face.

In yet another aspect, an acoustic unit includes an acoustically septumized cell, and a vapor chamber attached across the cell. In relation to the vapor chamber, the remainder of the acoustic unit is made at least partially from a thermally nonconductive material, and the vapor chamber is configured to employ vapor-liquid phase changing to help move heat past the cell. Moreover, the acoustic unit has a frequency target, and the vapor chamber is an acoustic element, whereby the acoustic unit is configured to particularly affect frontal acoustic excitation about the frequency target using the vapor chamber.

These and other aspects will be described in additional detail below.

BRIEF DESCRIPTION OF THE DRAWINGS

The various features, advantages and other uses of the present embodiments will become more apparent by referring to the following detailed description and drawing in which.

DETAILED DESCRIPTION

This disclosure teaches an acoustic panel that is broadly employable in various applications and with various items that generate both acoustic excitation and heat. The acoustic panel includes a cellular acoustic unit layer that features acoustic units. The acoustic units include acoustically septumized cells and vapor chambers attached across the cells. Using the acoustic septa and other acoustic elements, if any, attached across the cells, the acoustic unit layer is configured to attenuate the movement of frontal acoustic excitation past the acoustic unit layer. At the same time, using the vapor chambers, the acoustic unit layer is configured to allow the movement of heat past the acoustic unit layer. Specifically, among other things, the vapor chambers are configured to employ vapor-liquid phase changing to help move heat past the cells. The vapor chambers may be the acoustic septa, whereby the cells are acoustically septumized. Alternatively, or additionally, the vapor chambers may be other acoustic elements, such as acoustic backings behind the acoustic septa.

Figure 1:
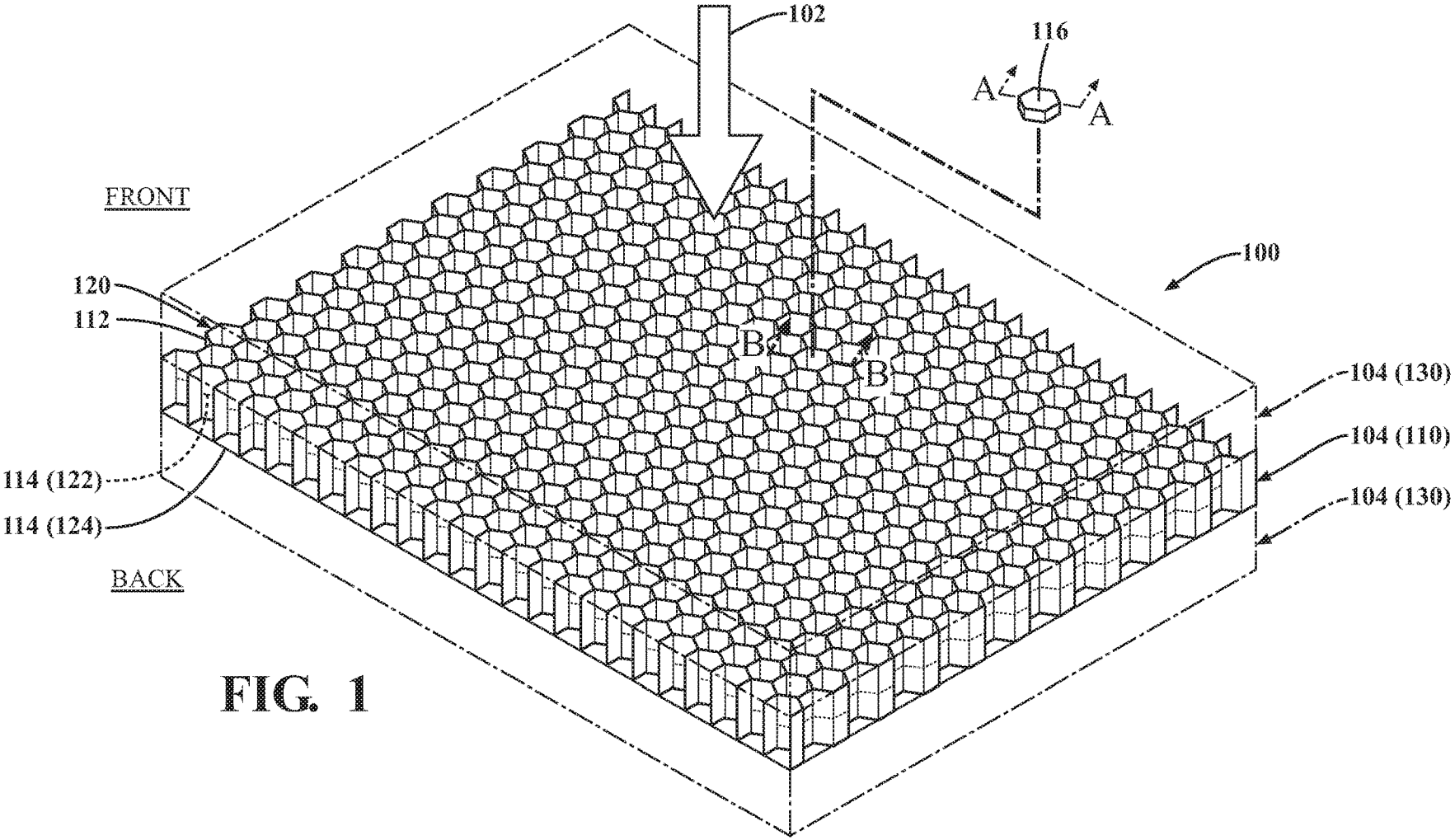
FIG. 1 is a partially exploded perspective view of an acoustic panel that includes a cellular acoustic unit layer that features acoustic units, showing the acoustic units including acoustically septumized cells and vapor chambers attached across the cells.

A representative acoustic panel 100 is shown in FIG. 1. Both the structure and the configuration of the acoustic panel 100 have an interdependent relationship with the intended spatial arrangement of the acoustic panel 100 relative to physical phenomena 102, including but not limited to acoustic excitation and heat. In this disclosure, uses of "front," "back" and the like refer to this relationship. For instance, the acoustic panel 100 is a panel-like structure that has a front and an opposing back. Moreover, the acoustic panel 100 is meant to assume frontal acoustic excitation. In other words, the acoustic panel 100 is intended for a spatial arrangement in which acoustic excitation moves toward the acoustic panel 100 and is assumed by the acoustic panel 100 at the front thereof. Similarly, the acoustic panel 100 is meant to assume either frontal heat or rear heat. In other words, the acoustic panel 100 is intended for a spatial arrangement in which relatively more heat is assumed by the acoustic panel 100 at either the front thereof or the back thereof.

The acoustic panel 100 includes one or more acoustic layers 104. As part of the construction of the acoustic panel 100, the acoustic layers 104 may be permanently interconnected as an integral unit. Similar to the acoustic panel 100 to which they belong, each acoustic layer 104 has a front and an opposing back. Moreover, the acoustic layers 104 are meant to assume frontal acoustic excitation. In other words, the acoustic layers 104 are intended for spatial arrangements, as part of the acoustic panel 100, in which acoustic excitation moves toward the acoustic layers 104 and is assumed by the acoustic layers 104 at the fronts thereof either directly or via transfer from one or more preceding acoustic layers 104, if any. Similarly, the acoustic layers 104 are meant to assume either frontal heat or rear heat. In other words, the acoustic layers 104 are intended for spatial arrangements, as part of the acoustic panel 100, in which relatively more heat is assumed by the acoustic layers 104 at either the fronts thereof or the backs thereof either directly or via transfer from one or more preceding acoustic layers 104, if any.

Among the acoustic layers 104, the acoustic panel 100 includes a cellular acoustic unit layer 110. As part of the acoustic unit layer 110, the acoustic panel 100 includes normally-oriented rigid cells 112, as well as transversely-oriented acoustic elements 114 and transversely-oriented two-phase heat-spreading vapor chambers 116 attached across (i.e., to span the inside of) the cells 112 under fixed boundary conditions therewith. Although the acoustic panel 100, as shown, includes one acoustic unit layer 110, it will be understood that this disclosure is applicable in principle to otherwise similar acoustic panels 100 including multiple acoustic unit layers 110.

Using the acoustic elements 114, the acoustic unit layer 110 is configured to attenuate the movement of frontal acoustic excitation past the acoustic unit layer 110 and, ultimately, behind the acoustic panel 100 to which it belongs. At the same time, using the vapor chambers 116, the acoustic unit layer 110 is configured to allow the movement of heat past the acoustic unit layer 110 and, ultimately, past the acoustic panel 100 to which it belongs. For instance, this description follows with reference to the acoustic unit layer 110 being configured to allow the movement of frontal heat past the acoustic unit layer 110 and, ultimately, behind the acoustic panel 100 to which it belongs. However, it will be understood that this disclosure is applicable in principle to otherwise similar acoustic unit layers 110 configured to allow the movement of rear heat past the acoustic unit layers 110 and, ultimately, in front of the acoustic panels 100 to which they belong.

In addition to the basic objective of attenuating the movement of frontal acoustic excitation past the acoustic unit layer 110, the acoustic unit layer 110 has the basic objectives of improving manufacturability, lowering mass and the like. The acoustic unit layer 110 also has the supplemental objective of allowing the movement of frontal heat past the acoustic unit layer 110. It is contemplated that by promoting one or more of the basic objectives, the basic objectives may compete with the supplemental objective. Accordingly, both the construction and the configuration of the acoustic unit layer 110 feature a collaborative relationship for promoting both the basic objectives and the competing supplemental objective.

Specifically, as part of the collaborative relationship, to promote the basic objectives, the acoustic unit layer 110 is made at least partially from one or more polymers. Assuming the polymers are thermally nonconductive materials, it is contemplated that by making the acoustic unit layer 110 at least partially from the polymers, the basic objectives compete with the supplemental objective. Accordingly, also as part of the collaborative relationship, to promote the competing supplemental objective, the acoustic unit layer 110 includes the vapor chambers 116, while leaving the remainder of the acoustic unit layer 110 made at least partially from the polymers. Moreover, the remainder of the acoustic unit layer 110 exposes the vapor chambers 116 to both frontal heat mediums or, in other words, mediums about the fronts of the cells 112 ahead of the acoustic elements 114, and heat dissipation mediums or, in other words, mediums about the backs of the cells 112 behind the acoustic elements 114, either directly or via transfer therefrom. Among other things, it follows that as the product of the collaborative relationship, notwithstanding the remainder of the acoustic unit layer 110 being made at least partially from the polymers, the acoustic unit layer 110, with the included vapor chambers 116, will not act as a barrier to the movement of frontal heat past the acoustic unit layer 110.

With the acoustic unit layer 110 included as part of the acoustic panel 100, the acoustic panel 100 is correspondingly configured to attenuate the movement of frontal acoustic excitation behind the acoustic panel 100 and, at the same time, allow the movement of frontal heat behind the acoustic panel 100. Accordingly, the acoustic panel 100 is broadly employable in various applications and with various items that generate both acoustic excitation and heat, including but not limited to employments in which overheating in relation to either the items or their environments, or both, might otherwise be a concern.

For example, the acoustic panel 100 may be employed in any combination of automotive applications, marine applications, aircraft applications, construction applications, residential applications, commercial applications, industrial applications and the like. In these and other applications, the acoustic panel 100 may be employed on, in, about or otherwise with various items to attenuate the movement of frontal acoustic excitation therefrom behind the acoustic panel 100 while, at the same time, allowing the movement of frontal heat therefrom behind the acoustic panel 100. For instance, the acoustic panel 100 may be employed as an acoustic silencer on or in items, including but not limited to as an exterior cover (e.g., a beauty cover) on items such as engines, including internal combustion engines, motors, including electric motors, transmissions, differentials and the like. Alternatively, or additionally, the acoustic panel 100 may be employed as an acoustic barrier about items, including but not limited to as a highway wall about road going vehicles.

In the acoustic unit layer 110, each cell 112 is a closed cross-sectional tubular cell-like structure that, absent elements attached across the cell 112, is open-ended. The cells 112 may serve as acoustic waveguides. As part of the construction of the acoustic unit layer 110, the cells 112 may be permanently interconnected. The cells 112 are regularly arranged, and may have any combination of polygonal and non-polygonal cross-sectional shapes. In these and other configurations, the cells 112 may have any combination of uniform and varying heights, cross-sectional dimensions, cross-sectional shapes and the like. In these and other configurations, the cells 112 may be regularly arranged with or without interstitial vacancies, including but not limited to tessellated without interstitial vacancies. For instance, as shown, the acoustic panel 100 includes honeycomb-patterned uniform height, uniform hexagonal cross-section and uniform cross-sectional dimension cells 112.

As a related part of the acoustic unit layer 110, the acoustic panel 100 includes normally-oriented acoustic units 120 whose construction is based on the cells 112. Specifically, each acoustic unit 120 includes a cell 112. In the acoustic panel 100, all of the cells 112 may belong to the acoustic units 120. Alternatively, some but not all of the cells 112 may belong to the acoustic units 120. Like the cells 112 on which their construction is based, the acoustic units 120 are regularly arranged, and may have any combination of polygonal and non-polygonal cross-sectional shapes. In these and other configurations, the acoustic units 120 may have any combination of uniform and varying heights, cross-sectional dimensions, cross-sectional shapes and the like. In these and other configurations, the acoustic units 120 may be regularly arranged with or without interstitial vacancies, including but not limited to tessellated without interstitial vacancies. For instance, as shown, the acoustic panel 100 includes honeycomb-patterned uniform height, uniform hexagonal cross-section and uniform cross-sectional dimension acoustic units 120.

In addition to the cell 112 thereof, each acoustic unit 120 includes one or more of the acoustic elements 114. For instance, the cells 112 are acoustically septumized. Specifically, the acoustic units 120 include one or more acoustic septa 122 attached across the cells 112. Moreover, the acoustic units 120 include one or more acoustic backings 124 attached across the cells 112 behind the acoustic septa 122.

For purposes of attenuating the movement of frontal acoustic excitation past the acoustic unit layer 110, the acoustic units 120 have one or more frequency targets (e.g., frequencies, frequency ranges and the like) about which the acoustic units 120 are configured to particularly reflect, absorb or otherwise affect frontal acoustic excitation using the acoustic elements 114. In some implementations of the acoustic units 120, for one, some or all of the frequency targets, the acoustic elements 114 may serve as acoustic metamaterials (AMMs) with respect to particularly affecting frontal acoustic excitation about the frequency targets. Alternatively, or additionally, the acoustic units 120 to which the acoustic elements 114 belong may serve as AMMs with respect to particularly affecting frontal acoustic excitation about the frequency targets. Although the acoustic units 120 particularly affect frontal acoustic excitation about the frequency targets, it will be understood that this disclosure is not exclusive to the acoustic units 120 somewhat or even particularly affecting frontal acoustic excitation outside the frequency targets.

In this disclosure, in relation to the cells 112, uses of "wavelength" and the like refer to the frequency targets. For instance, for an acoustic unit 120 with a frequency target, a subwavelength cell 112 means a cell 112 whose height and cross section are significantly smaller than the wavelengths of frontal acoustic excitation about the frequency target. A subwavelength cell 112 may mean a cell 112 whose height and cross section are approximately ten or more times smaller than the wavelengths of frontal acoustic excitation about the frequency target. Alternatively, or additionally, a subwavelength cell 112 may mean a cell 112 whose height and cross section are approximately one hundred or more times smaller than the wavelengths of frontal acoustic excitation about the frequency target.

In relation to the acoustic units 120, uses of "acoustic impedance matched," "acoustic impedance matching" and the like refer to the frequency targets. Both the frontal acoustic impedances of the acoustic units 120 or, in other words, the acoustic impedances of the acoustic units 120 at the proceeding acoustic elements 114, and the acoustic impedances of frontal acoustic excitation mediums or, in other words, mediums about the fronts of the cells 112 ahead of the acoustic elements 114, are frequency-dependent. For an acoustic unit 120 with a frequency target, the acoustic unit 120 being acoustic impedance matched means that, about the frequency target, the acoustic unit 120 has a frontal acoustic impedance that matches the acoustic impedance of an intended frontal acoustic excitation medium. For acoustic units 120 with varying frequency targets, uniform acoustic impedance matching means that, about the varying frequency targets, the acoustic units 120 have frontal acoustic impedances that match the acoustic impedance of an intended common frontal acoustic excitation medium.

In relation to the acoustic elements 114, uses of "anti-vibration," "vibratory" and the like refer to the frequency targets. For instance, an anti-vibration acoustic element 114 means an acoustic element 114 that substantially does not vibrate under frontal acoustic excitation about the frequency target. Relatedly, an anti-vibration acoustic element 114 means an acoustic element 114 that perfectly, near perfectly or otherwise substantially reflects frontal acoustic excitation about the frequency target. On the other hand, a vibratory acoustic element 114 means an acoustic element 114 that substantially vibrates under frontal acoustic excitation about the frequency target with the same phase and the same amplitude as frontal acoustic excitation. Relatedly, a vibratory acoustic element 114 means an acoustic element 114 that particularly propagatively absorbs frontal acoustic excitation about the frequency target. In the case of an acoustic unit 120 that is acoustic impedance matched, a vibratory acoustic element 114 means an acoustic element 114 that, moreover, substantially does not reflect frontal acoustic excitation about the frequency target, and therefore perfectly, near perfectly or otherwise substantially propagatively absorbs frontal acoustic excitation about the frequency target.

Uses of "stiff," "resiliently flexible" and the like refer to frontal acoustic excitation about the frequency targets. For instance, a stiff acoustic element 114 means an acoustic element 114 that exhibits stiffness to frontal acoustic excitation about the frequency targets. On the other hand, a resiliently flexible acoustic element 114 means an acoustic element 114 that exhibits resilient flexibility, including but not limited to elasticity, to frontal acoustic excitation about the frequency targets.

Uses of "plate" and the like refer to stiff plate-like structures. A plate may mean a thick plate or, in other words, a relatively thicker intrinsically stiff plate-like structure. Alternatively, a plate may mean thin plate or, in other words, a relatively thinner and otherwise flexible acquired-stiffness plate-like structure whose stiffness is acquired via applied tension under a fixed boundary condition with a cell 112. On the other hand, uses of "membrane" and the like refer to resiliently flexible, including elastic, membrane-like structures.

With the acoustic units 120 included as part of the acoustic unit layer 110, the acoustic unit layer 110 is correspondingly configured to particularly affect frontal acoustic excitation about the frequency targets using the acoustic elements 114. In broadband implementations, the acoustic unit layer 110 has one or more frequency bandwidths, and the acoustic units 120 have varying frequency targets throughout the frequency bandwidths. Alternatively, the acoustic units 120 could have uniform frequency targets.

The acoustic panel 100 may include vapor chambers 116 for all of the cells 112. Alternatively, the acoustic panel 100 may include vapor chambers 116 for some but not all of the cells 112. Relatedly, the acoustic panel 100 may include vapor chambers 116 for one, some, all or none of the cells 112 of the acoustic units 120. For instance, the acoustic panel 100 may include the acoustic units 120, including the cells 112 thereof, and vapor chambers 116 for the cells 112 of the acoustic units 120. Alternatively, or additionally, the acoustic panel 100 may include the acoustic units 120, including the cells 112 thereof, and vapor chambers 116 for other cells 112. In the case of vapor chambers 116 for the cells 112 of the acoustic units 120, the vapor chambers 116 are one, some or all of the acoustic elements 114. For instance, the vapor chambers 116 may be the acoustic septa 122, whereby the cells 112 of the acoustic units 120 are acoustically septumized. Alternatively, or additionally, the vapor chambers 116 may be the acoustic backings 124 attached across the cells 112 of the acoustic units 120 behind the acoustic septa 122.

For purposes of allowing the movement of frontal heat past the acoustic unit layer 110, the vapor chambers 116 are configured to employ vapor-liquid phase changing to help move frontal heat past the cells 112. Specifically, the vapor chambers 116 are configured to absorb frontal heat from about the cells 112, employ vapor-liquid phase changing to effectively thermally conduct absorbed frontal heat, and dissipate effectively thermally conducted frontal heat away from the cells 112. Accordingly, the vapor chambers 116 open effectively thermally conductive paths for frontal heat to move past the cells 112.

In addition to the acoustic unit layer 110, the acoustic panel 100 includes one or more bulk acoustic layers 130, including a proceeding bulk acoustic layer 130 and a succeeding bulk acoustic layer 130. The bulk acoustic layers 130 are made from one or more bulk materials. For instance, the bulk acoustic layers 130 may be made from one or more foams. As a complement to the configuration of the acoustic units 120 and the acoustic unit layer 110 to which they belong, the bulk acoustic layers 130 are configured to particularly reflect, absorb or otherwise affect frontal acoustic excitation outside the frequency targets. Although the acoustic panel 100, as shown, includes one proceeding bulk acoustic layer 130, it will be understood that this disclosure is applicable in principle to otherwise similar acoustic panels 100 including multiple proceeding bulk acoustic layers 130 or no proceeding bulk acoustic layers 130. Similarly, although the acoustic panel 100, as shown, includes one succeeding bulk acoustic layer 130, it will be understood that this disclosure is applicable in principle to otherwise similar acoustic panels 100 including multiple succeeding bulk acoustic layers 130 or no succeeding bulk acoustic layers 130.

Figure 2:
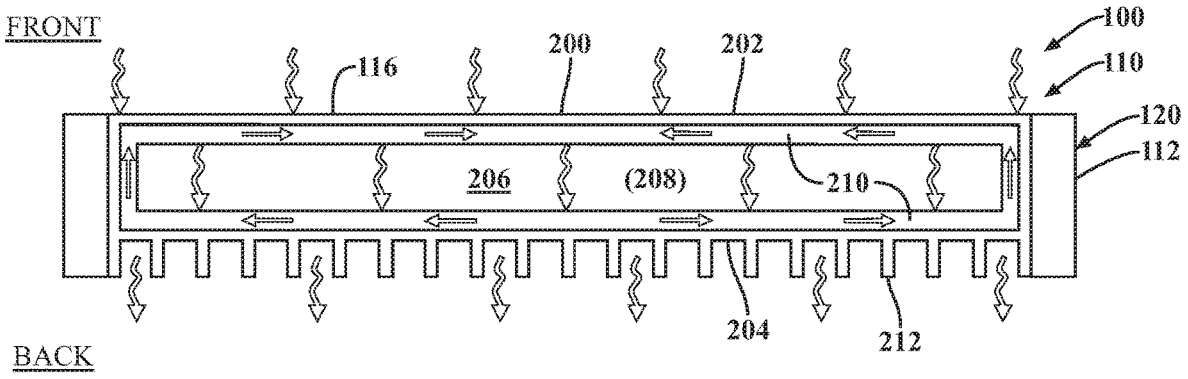
FIG. 2 is a cross-sectional view of the acoustic unit layer taken along the line A-A in FIG. 1, showing additional aspects of the vapor chambers.

As shown with additional reference to FIG. 2, each vapor chamber 116 has a transversely-oriented body 200 with an exterior heat absorption face 202 and an opposing exterior heat dissipation face 204. The body 200 is made from one or more thermally conductive materials. For instance, the body 200 may be made from one or more metals. From their positions across the cells 112, each vapor chamber 116 separates frontal heat mediums from heat dissipation mediums using the body 200. Moreover, each vapor chamber 116 is exposed to frontal heat mediums at the heat absorption face 202, and exposed to heat dissipation mediums at the heat dissipation face 204. For instance, the heat absorption face 202 may be left substantially open for communication with frontal heat mediums. Alternatively, or additionally, the heat dissipation face 204 may be left substantially open for communication with heat dissipation mediums. Relatedly, each vapor chamber 116 is configured to absorb frontal heat from frontal heat mediums at the heat absorption face 202, employ vapor-liquid phase changing to effectively thermally conduct absorbed frontal heat through the body 200 to the heat dissipation face 204, and dissipate effectively thermally conducted frontal heat to heat dissipation mediums at the heat dissipation face 204.

As part of the body 200, each vapor chamber 116 defines a sealed internal reservoir 206 between the heat absorption face 202 and the heat dissipation face 204. In the reservoir 206, each vapor chamber 116 houses a working fluid 208. The working fluid 208 is in equilibrium with its own vapor, and subject to vapor-liquid phase changing. Specifically, the working fluid 208 is subject to being vaporized or, in other words, changing from the liquid phase to the vapor phase, and being condensed or, in other words, changing from the vapor phase to the liquid phase. In relation to the working fluid 208, each vapor chamber 116 includes an internal fluid wick 210 bordering the reservoir 206, including along the heat absorption face 202, along the heat dissipation face 204, and between the heat absorption face 202 and the heat dissipation face 204. Moreover, each vapor chamber 116 includes one or more exterior fins 212 at the heat dissipation face 204.

In association with absorbing frontal heat from frontal heat mediums at the heat absorption face 202, each vapor chamber 116 is configured to vaporize the working fluid 208 at the heat absorption face 202 using absorbed frontal heat. In association with the working fluid 208 vaporizing at the heat absorption face 202, the working fluid 208 spreads throughout the reservoir 206. In association with the working fluid 208 spreading throughout the reservoir 206, each vapor chamber 116 is configured to condense the working fluid 208 at the heat dissipation face 204. In association with the working fluid 208 condensing at the heat dissipation face 204, each vapor chamber 116 is configured to employ capillary action to carry the condensed working fluid 208 from the heat dissipation face 204 to the heat absorption face 202 using the fluid wick 210. By continuing this cycle, each vapor chamber 116 is configured to employ vapor-liquid phase changing to effectively thermally conduct absorbed frontal heat through the body 200 to the heat dissipation face 204. Each vapor chamber 116 may have an effective thermal conductivity that exceeds highly thermally conductive materials, such as copper, diamond and the like. In association with employing vapor-liquid phase changing to effectively thermally conduct absorbed frontal heat through the body 200 to the heat dissipation face 204, each vapor chamber 116 is configured to dissipate effectively thermally conducted frontal heat to heat dissipation mediums at the heat dissipation face 204 using the fins 212.

In the acoustic unit layer 110, in relation to the vapor chambers 116, the remainder of the acoustic unit layer 110 includes the cells 112. In the case of vapor chambers 116 for the cells 112 of the acoustic units 120, the remainder of the acoustic unit layer 110 relatedly includes the remainder of the acoustic units 120 whose construction is based on the cells 112, including the acoustic elements 114, if any, besides the vapor chambers 116. As part of the remainder of the acoustic unit layer 110, the remainder of the acoustic units 120 are made at least partially from the polymers. Moreover, the remainder of the acoustic units 120 expose the vapor chambers 116 to both frontal heat mediums and heat dissipation mediums. Beyond this, both the construction and the configuration of the acoustic units 120, including both the construction and the configuration of the acoustic elements 114, are implementation-dependent.

Figure 3:
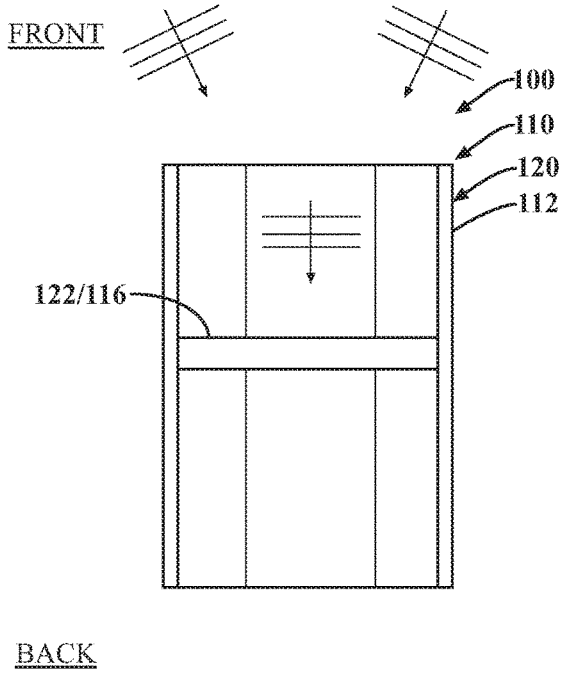
FIG. 3 is a cross-sectional view of the acoustic unit layer taken along the line B-B in FIG. 1, showing additional aspects of the acoustic units for a representative reflection-oriented implementation of the acoustic unit layer, in which the acoustic units include the acoustically septumized cells and the vapor chambers attached across the cells, and the vapor chambers are the acoustic septa, whereby the cells are acoustically septumized.

As shown with additional reference to FIG. 3, for example, each acoustic unit 120 for a representative reflection-oriented implementation of the acoustic unit layer 110 includes the acoustically septumized cell 112 and the vapor chamber 116 attached across the cell 112. Specifically, in addition to the cell 112, each acoustic unit 120 includes the acoustic septum 122 attached across the cell 112. Moreover, the vapor chamber 116 is the acoustic septum 122. The acoustic septum/vapor chamber 122/116 is attached across the cell 112 at a certain depth. For instance, the acoustic septum/vapor chamber 122/116 is, as shown, attached mid-depth across the cell 112. Relatedly, the cell 112 is a subwavelength cell 112 configured to rectify diffused frontal acoustic excitation into normal frontal acoustic excitation. Although each acoustic unit 120, as shown, includes one acoustic septum/vapor chamber 122/116, it will be understood that this disclosure is applicable in principle to otherwise similar acoustic units 120 including multiple acoustic septa/vapor chambers 122/116. Each acoustic unit 120 does not include other elements, including but not limited to other acoustic elements 114, attached across the cell 112. For instance, each acoustic unit 120 does not include an acoustic backing 124 attached across the cell 112 behind the acoustic septum/vapor chamber 122/116.

In this and other reflection-oriented implementations of the acoustic unit layer 110, the acoustic units 120 have one or more cutoff reflection frequencies, including varying cutoff reflection frequencies throughout a reflection frequency bandwidth, below which the acoustic units 120 are configured to substantially reflect (as opposed to absorb) frontal acoustic excitation.

Specifically, the acoustic septa/vapor chambers 122/116 are anti-vibration plates having one or more resonance frequencies (e.g., first resonance frequencies, second resonance frequencies, etc.) significantly higher than the cutoff reflection frequencies. For instance, the anti-vibration plates may have first resonance frequencies approximately ten or more times higher than the cutoff reflection frequencies. Accordingly, below the cutoff reflection frequencies, including in broadband reflection frequency ranges below one, some or all of the cutoff reflection frequencies, the anti-vibration plates and, as a result, the acoustic units 120, substantially reflect frontal acoustic excitation.

For one, some or all of the cutoff reflection frequencies, the anti-vibration plates may serve as AMMs with respect to substantially reflecting frontal acoustic excitation below the cutoff reflection frequencies. Specifically, the anti-vibration plates may be anti-vibration thin plates having broadband negative effective mass densities below one, some or all of the cutoff reflection frequencies. Relatedly, the acoustic units 120 to which the anti-vibration plates belong may serve as AMMs with respect to substantially reflecting frontal acoustic excitation below the cutoff reflection frequencies.

In relation to the acoustic septum/vapor chamber 122/116, the remainder of each acoustic unit 120 is made at least partially from the polymers to promote the basic objectives of improving manufacturability, lowering mass and the like. Specifically, the cell 112 is made from the polymers. For instance, the cell 112 may be made from one or more resins. Intrinsically, the remainder of each acoustic unit 120 directly exposes the acoustic septum/vapor chamber 122/116 to both frontal heat mediums and heat dissipation mediums. Accordingly, although the polymers are thermally nonconductive materials, the acoustic septum/vapor chamber 122/116 is left to promote the supplemental objective of allowing the movement of frontal heat past the acoustic unit layer 110.

Figure 4:
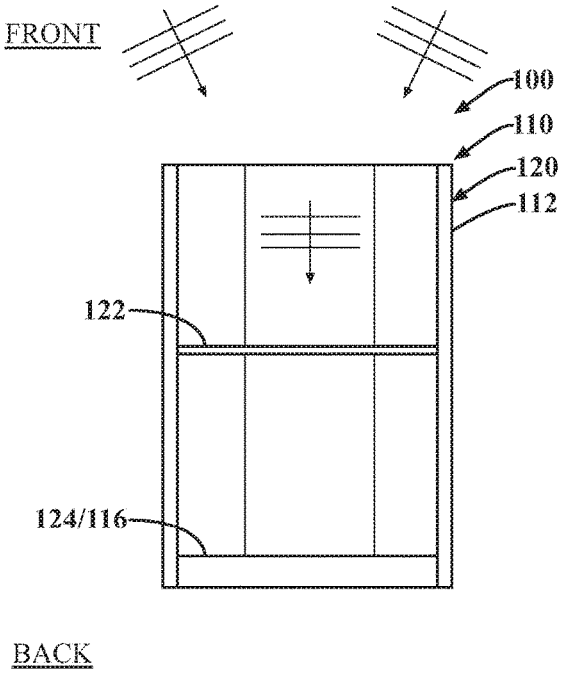
FIG. 4 is a cross-sectional view of the acoustic unit layer taken along the line B-B in FIG. 1, showing additional aspects of the acoustic units for a representative absorption-oriented implementation of the acoustic unit layer, in which the acoustic units include the acoustically septumized cells and the vapor chambers attached across the cells, and the vapor chambers are acoustic backings attached across the cells behind the acoustic septa.

As shown with additional reference to FIG. 4, for example, each acoustic unit 120 for a representative absorption-oriented implementation of the acoustic unit layer 110 includes the acoustically septumized cell 112 and the vapor chamber 116 attached across the cell 112. Specifically, in addition to the cell 112, each acoustic unit 120 includes the acoustic septum 122 attached across the cell 112. The acoustic septum 122 is attached across the cell 112 at a certain depth. For instance, the acoustic septum 122 is, as shown, attached mid-depth across the cell 112. Relatedly, the cell 112 is a subwavelength cell 112 configured to rectify diffused frontal acoustic excitation into normal frontal acoustic excitation. Although each acoustic unit 120, as shown, includes one acoustic septum 122, it will be understood that this disclosure is applicable in principle to otherwise similar acoustic units 120 including multiple acoustic septa 122. Moreover, each acoustic unit 120 includes an acoustic backing 124 attached across the cell 112 behind the acoustic septum 122. Moreover, the vapor chamber 116 is the acoustic backing 124.

In this and other absorption-oriented implementations of the acoustic unit layer 110, the acoustic units 120 have one or more peak absorption frequencies, including varying peak absorption frequencies throughout an absorption frequency bandwidth, at which the acoustic units 120 are configured to substantially non-propagatively absorb (as opposed to reflect or propagatively absorb) frontal acoustic excitation. Moreover, the acoustic units 120 have one or more cutoff reflection frequencies, including varying cutoff reflection frequencies throughout a reflection frequency bandwidth, higher than the peak absorption frequencies, below which the acoustic units 120 are configured to substantially reflect (as opposed to absorb) frontal acoustic excitation outside the peak absorption frequencies.

Specifically, in relation to the peak absorption frequencies, the acoustic septa 122 are vibratory membranes having one or more resonance frequencies (e.g., first resonance frequencies, second resonance frequencies, etc.) lower than the peak absorption frequencies. For instance, the vibratory membranes may have first resonance frequencies lower than the peak absorption frequencies. Moreover, in relation to the cutoff reflection frequencies and the peak absorption frequencies, the acoustic backings/vapor chambers 124/116 are anti-vibration back plates having one or more resonance frequencies (e.g., first resonance frequencies, second resonance frequencies, etc.) significantly higher than the cutoff reflection frequencies and the peak absorption frequencies. For instance, the anti-vibration back plates may have first resonance frequencies approximately ten or more times higher than the cutoff reflection frequencies and the peak absorption frequencies. Among other things, it follows that for one, some or all of the peak absorption frequencies, the peak absorption frequencies are between the resonance frequencies of the vibratory membranes and the resonance frequencies of the anti-vibration back plates. For instance, it follows that the peak absorption frequencies may be between the first resonance frequencies of the vibratory membranes and the first resonance frequencies of the anti-vibration back plates.

Moreover, in relation to the peak absorption frequencies, the acoustic units 120 are acoustic impedance matched. In the case of varying peak absorption frequencies throughout an absorption frequency bandwidth, the acoustic units 120 have uniform acoustic impedance matching. The acoustic units 120 may be acoustic impedance matched, including having uniform acoustic impedance matching, to fluids, including but not limited to gasses. For instance, for applications of the acoustic panel 100 in everyday environments, the acoustic units 120 may be acoustic impedance matched, including having uniform acoustic impedance matching, to air.

Accordingly, below the cutoff reflection frequencies, including in broadband reflection frequency ranges below one, some or all of the cutoff reflection frequencies and encompassing the peak absorption frequencies, the anti-vibration back plates substantially reflect propagated frontal acoustic excitation, if any, back toward the vibratory membranes. Moreover, at the peak absorption frequencies, with the acoustic units 120 being acoustic impedance matched, the vibratory membranes substantially propagatively absorb, and therefore substantially propagate, frontal acoustic excitation, the anti-vibration back plates substantially reflect propagated frontal acoustic excitation back toward the vibratory membranes, and the overall sound energy from frontal acoustic excitation and reflected propagated frontal acoustic excitation is therefore substantially converted into elastic energy gained by the vibratory membranes. As a result, the acoustic units 120 substantially non-propagatively absorb frontal acoustic excitation at the peak absorption frequencies. Moreover, outside the peak absorption frequencies but below the cutoff reflection frequencies, even though the acoustic units 120 do not substantially non-propagatively absorb frontal acoustic excitation, the acoustic units 120 nonetheless substantially reflect frontal acoustic excitation.

For one, some or all of the peak absorption frequencies, the vibratory membranes may serve as AMMs with respect to substantially propagatively absorbing frontal acoustic excitation at the peak absorption frequencies. Specifically, the vibratory membranes may have anomalous positive effective mass densities at one, some or all of the peak absorption frequencies. Moreover, for one, some or all of the cutoff reflection frequencies, and for one, some or all of the peak absorption frequencies, the anti-vibration back plates may serve as AMMs with respect to substantially reflecting propagated frontal acoustic excitation back toward the vibratory membranes at the peak absorption frequencies and otherwise below the cutoff reflection frequencies. Specifically, the anti-vibration back plates may be anti-vibration thin back plates having broadband negative effective mass densities at one, some or all of the peak absorption frequencies and otherwise below one, some or all of the cutoff reflection frequencies. Relatedly, the acoustic units 120 to which the vibratory membranes and the anti-vibration back plates belong may serve as AMMs with respect to substantially non-propagatively absorbing frontal acoustic excitation at the peak absorption frequencies and substantially reflecting frontal acoustic excitation outside the peak absorption frequencies but below the cutoff reflection frequencies.

In relation to the acoustic backing/vapor chamber 124/116, the remainder of each acoustic unit 120 is made at least partially from the polymers to promote the basic objective of attenuating the movement of frontal acoustic excitation past the acoustic unit layer 110. Specifically, the acoustic septum 122, in relation to being a vibratory membrane, is made from the polymers. For instance, the acoustic septum 122 may be made from one or more rubbers, including but not limited to one or more silicon-based rubbers, such as polydimethylsiloxane (PDMS). Intrinsically, the remainder of each acoustic unit 120 directly exposes the acoustic backing/vapor chamber 124/116 to heat dissipation mediums. With the acoustic backing/vapor chamber 124/116 attached across the cell 112 behind the acoustic septum 122, and the acoustic septum 122 made from the polymers, the cell 112, as part of the remainder of each acoustic unit 120, is made from one or more thermally conductive materials to indirectly expose the acoustic backing/vapor chamber 124/116 to frontal heat mediums via transfer therefrom. For instance, the cell 112 may be made from one or more metals. Accordingly, although the polymers are thermally nonconductive materials, the acoustic backing/vapor chamber 124/116 is left to promote the supplemental objective of allowing the movement of frontal heat past the acoustic unit layer 110.

In relation to the cells 112 of the acoustic units 120, the construction of the acoustic unit layer 110 may be based on any combination of standalone cell-like structures and cellular panels or, in other words, panel-like structures that include individual cell-like structures that are permanently interconnected as an integral unit. In relation to the acoustic elements 114 and the vapor chambers 116 of the acoustic units 120, the construction of the acoustic unit layer 110 may be based on any suitable combination of standalone acoustic elements, standalone vapor chambers and standalone acoustic element/vapor chambers embedded on, in or otherwise with the cells 112, including but not limited to standalone acoustic septa, standalone acoustic backings, standalone acoustic septum/vapor chambers and standalone acoustic backing/vapor chambers. Alternatively, or additionally, the construction of the acoustic unit layer 110 may be based on any suitable combination of acoustic element layers, vapor chamber layers, acoustic element/vapor chamber layers and acoustic element layers with acoustic element/vapor chamber locations layered on, in or otherwise with the cells 112, whose coincident locations therewith form associated acoustic elements, vapor chambers and acoustic element/vapor chambers, as the case may be, including but not limited to acoustic septum layers, acoustic septum/vapor chamber layers, acoustic septum layers with acoustic septum/vapor chamber locations, acoustic backing layers, acoustic backing/vapor chamber layers and acoustic backing layers with acoustic backing/vapor chamber locations.

Figure 5:
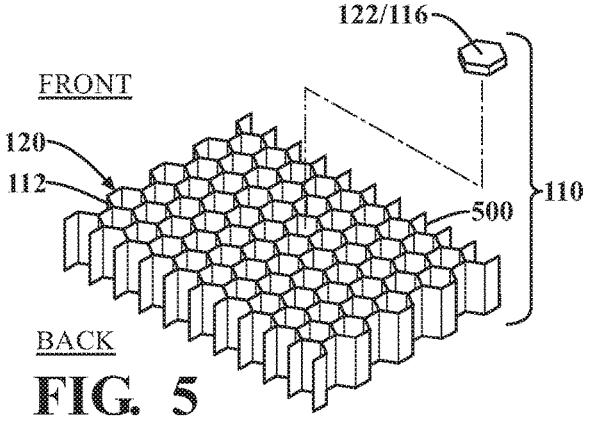
FIG. 5 is a partially exploded perspective view of the acoustic unit layer, showing a representative non-layered reflection-oriented implementation thereof, in which the construction of the acoustic unit layer is based on a cellular panel and standalone acoustic septum/vapor chambers.

As shown with additional reference to FIG. 5, for example, in a representative non-layered reflection-oriented implementation thereof, the acoustic unit layer 110 includes a cellular panel 500 that forms the cells 112, and standalone acoustic element/vapor chambers embedded with the cells 112. Specifically, as the standalone acoustic element/vapor chambers, the acoustic unit layer 110 includes standalone acoustic septum/vapor chambers 122/116 embedded in the cells 112 at certain depths.

Figure 6:
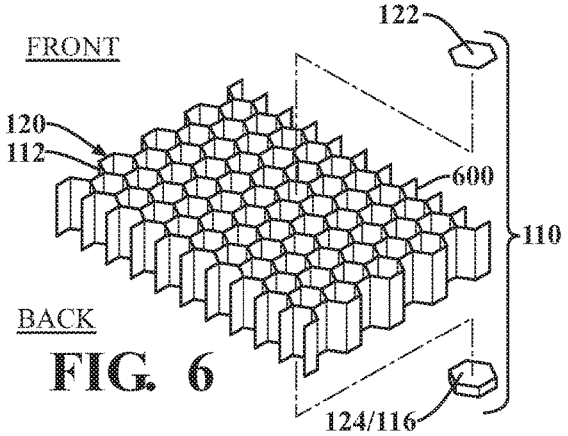
FIG. 6 is a partially exploded perspective view of the acoustic unit layer, showing a representative non-layered absorption-oriented implementation thereof, in which the construction of the acoustic unit layer is based on a cellular panel, standalone acoustic septa and standalone acoustic backing/vapor chambers.

As shown with additional reference to FIG. 6, for example, in a representative non-layered absorption-oriented implementation thereof, the acoustic unit layer 110 includes a cellular panel 600 that forms the cells 112, and standalone acoustic elements and standalone acoustic element/vapor chambers embedded with the cells 112. Specifically, as the standalone acoustic elements, the acoustic unit layer 110 includes standalone acoustic septa 122 embedded in the cells 112 at certain depths. Moreover, as the standalone acoustic element/vapor chambers, the acoustic unit layer 110 includes standalone acoustic backing/vapor chambers 124/116 embedded in the cells 112 behind the standalone acoustic septa 122.

Figure 7:
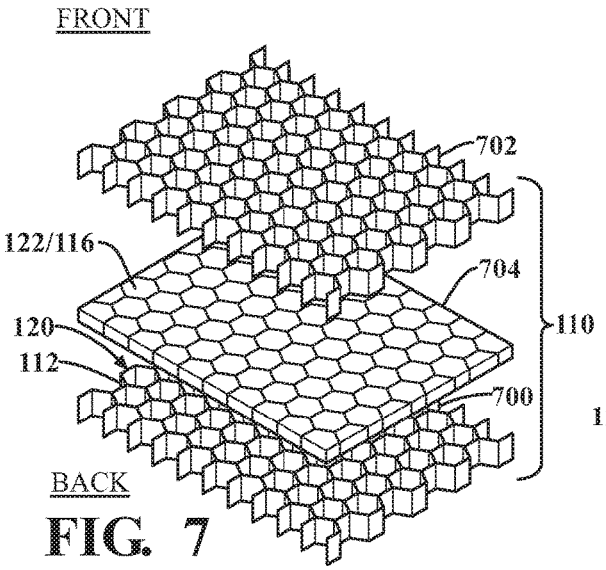
FIG. 7 is an exploded perspective view of the acoustic unit layer, showing a representative layered reflection-oriented implementation thereof, in which the construction of the acoustic unit layer is based on cellular panels and an acoustic septum/vapor chamber layer.

As shown with additional reference to FIG. 7, for example, in a representative layered reflection-oriented implementation thereof, the acoustic unit layer 110 includes one or more cellular panels that form the cells 112, and an acoustic element/vapor chamber layer layered with the cells 112, whose coincident locations therewith form associated acoustic element/vapor chambers. Specifically, the acoustic unit layer 110 includes a base cellular panel 700 that forms the bases of the cells 112. Ahead of the base cellular panel 700, the acoustic unit layer 110 also includes an aligned corresponding front cellular panel 702 that forms the fronts of the cells 112. Moreover, as the acoustic element/vapor chamber layer, the acoustic unit layer 110 includes an acoustic septum/vapor chamber layer 704 layered ahead of the base cellular panel 700, and therefore on the bases of the cells 112, whose coincident locations therewith form associated acoustic septum/vapor chambers 122/116. Specifically, the acoustic unit layer 110 includes the acoustic septum/vapor chamber layer 704 layered between the base cellular panel 700 and the front cellular panel 702, and therefore in the cells 112 at a certain depth, whose coincident locations therewith form associated acoustic septum/vapor chambers 122/116 in the cells 112 at certain depths.

Figure 8:
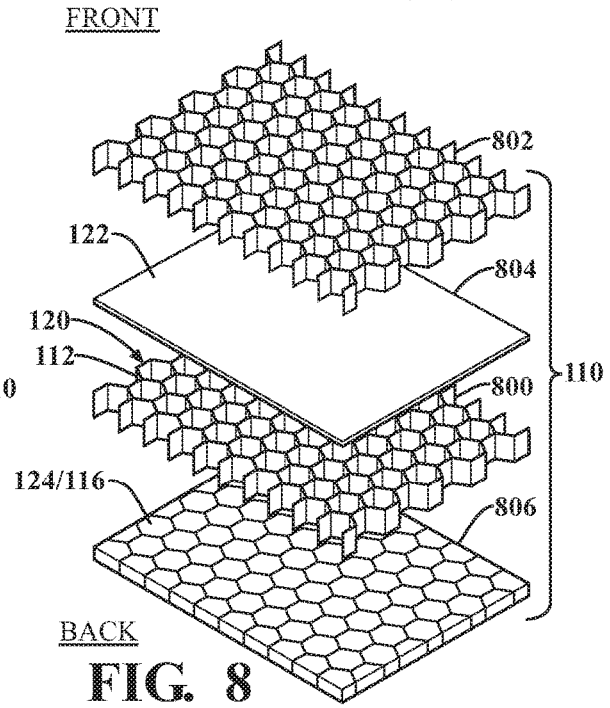
FIG. 8 is an exploded perspective view of the acoustic unit layer, showing a representative layered absorption-oriented implementation thereof, in which the construction of the acoustic unit layer is based on cellular panels, an acoustic septum layer and an acoustic backing/vapor chamber layer.

As shown with additional reference to FIG. 8, for example, in a representative layered absorption-oriented implementation thereof, the acoustic unit layer 110 includes one or more cellular panels that form the cells 112, and an acoustic element layer and an acoustic element/vapor chamber layer layered with the cells 112, whose coincident locations therewith form associated acoustic elements and acoustic element/vapor chambers. Specifically, the acoustic unit layer 110 includes a base cellular panel 800 that forms the bases of the cells 112. Ahead of the base cellular panel 800, the acoustic unit layer 110 also includes an aligned corresponding front cellular panel 802 that forms the fronts of the cells 112. Moreover, as the acoustic element layer, the acoustic unit layer 110 includes an acoustic septum layer 804 layered ahead of the base cellular panel 800, and therefore on the bases of the cells 112, whose coincident locations therewith form associated acoustic septa 122. Specifically, the acoustic unit layer 110 includes the acoustic septum layer 804 layered between the base cellular panel 800 and the front cellular panel 802, and therefore in the cells 112 at a certain depth, whose coincident locations therewith form associated acoustic septa 122 in the cells 112 at certain depths. Moreover, as the acoustic element/vapor chamber layer, the acoustic unit layer 110 includes an acoustic backing/vapor chamber layer 806 layered behind the base cellular panel 800, and therefore on the bases of the cells 112, whose coincident locations therewith form associated acoustic backing/vapor chambers 124/116.

As shown in FIGS. 7 and 8, for example, the construction of the acoustic unit layer 110 may be based on acoustic element/vapor chamber layers layered with the cells 112, whose coincident locations therewith each form an associated acoustic element/vapor chamber. As shown in FIG. 7, for instance, the construction of the acoustic unit layer 110 may be based on the acoustic septum/vapor chamber layer 704 layered in the cells 112, whose coincident locations therewith each form an associated acoustic septum/vapor chamber 122/116. As shown in FIG. 8, for instance, the construction of the acoustic unit layer 110 may be based on the acoustic backing/vapor chamber layer 806 layered on the cells 112, whose coincident locations therewith each form an associated acoustic backing/vapor chamber 124/116.

Figure 9:
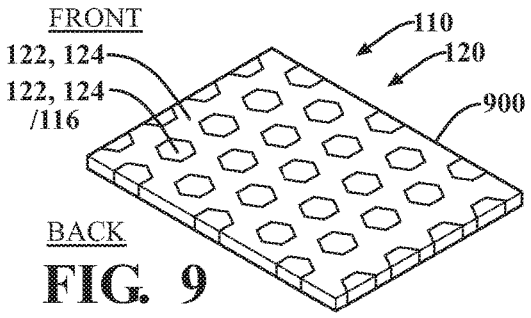
FIGS. 9 and 10 are perspective views of acoustic element layers with acoustic element/vapor chamber locations on which the construction of the acoustic unit layer may be based, representing alternatives to the acoustic septum/vapor chamber layer in FIG. 7 and the acoustic backing/vapor chamber layer in FIG. 8.
Figure 10:
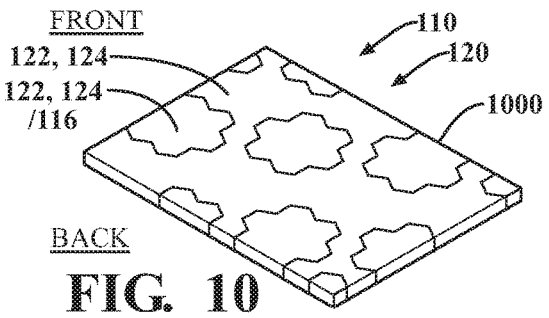

Alternatively, as shown with additional reference to FIGS. 9 and 10, for example, the construction of the acoustic unit layer 110 may be based on acoustic element layers with acoustic element/vapor chamber locations layered with the cells 112, whose coincident acoustic element/vapor chamber locations therewith each form an associated acoustic element/vapor chamber, and whose coincident locations therewith otherwise each form an associated acoustic element. As shown in FIGS. 9 and 10, for instance, the construction of the acoustic unit layer 110 may be based on acoustic septum layers 900, 1000 with acoustic septum/vapor chamber locations layered with the cells 112, whose coincident acoustic septum/vapor chamber locations therewith each form an associated acoustic septum/vapor chamber 122/116, and whose coincident locations therewith otherwise each form an associated acoustic septum 122. Alternatively, or additionally, the construction of the acoustic unit layer 110 may be based on acoustic backing layers 900, 1000 with acoustic backing/vapor chamber locations layered with the cells 112, whose coincident acoustic backing/vapor chamber locations therewith each form an associated acoustic backing/vapor chamber 124/116, and whose coincident locations therewith otherwise each form an associated acoustic backing 124.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An acoustic unit, comprising:

an acoustically septumized cell; and a vapor chamber attached across the cell under a fixed boundary condition therewith, the vapor chamber configured to employ vapor-liquid phase changing to help move heat past the cell; wherein the vapor chamber is an acoustic element, whereby the acoustic unit is configured to attenuate the movement of frontal acoustic excitation using the vapor chamber.

2. The acoustic unit of claim 1, wherein in relation to the vapor chamber, the remainder of the acoustic unit is made at least partially from a thermally nonconductive material.

3. The acoustic unit of claim 1, wherein the acoustic unit comprises:

the cell; and the vapor chamber attached across the cell as an acoustic septum, whereby the cell is acoustically septumized.

4. The acoustic unit of claim 3, wherein the acoustic unit has a cutoff reflection frequency, and the vapor chamber is an anti-vibration plate, whereby the acoustic unit is configured to substantially reflect frontal acoustic excitation below the cutoff reflection frequency using the vapor chamber.

5. The acoustic unit of claim 3, wherein the vapor chamber is attached across the cell at a depth, and the cell is configured to rectify diffused frontal acoustic excitation into normal frontal acoustic excitation.

6. The acoustic unit of claim 3, wherein the cell is made from a thermally nonconductive material.

7. The acoustic unit of claim 1, wherein the acoustic unit comprises:

the cell;

an acoustic septum attached across the cell under a fixed boundary condition therewith, whereby the cell is acoustically septumized; and the vapor chamber attached across the cell behind the acoustic septum as an acoustic backing.

8. The acoustic unit of claim 7, wherein the acoustic unit has a peak absorption frequency, and the acoustic septum is a vibratory membrane and the vapor chamber is an anti-vibration back plate, whereby the acoustic unit is configured to substantially non-propagatively absorb frontal acoustic excitation at the peak absorption frequency using the acoustic septum and the vapor chamber.

9. The acoustic unit of claim 7, wherein the acoustic septum is attached across the cell at a depth, and the cell is configured to rectify diffused frontal acoustic excitation into normal frontal acoustic excitation.

10. The acoustic unit of claim 7, wherein the acoustic septum is made from a thermally nonconductive material, and the cell is made from a thermally conductive material.

11. The acoustic unit of claim 1, wherein the vapor chamber has a body with an exterior heat absorption face and an opposing exterior heat dissipation face, and to help move heat past the cell, the vapor chamber is configured to absorb heat at the heat absorption face, employ vapor-liquid phase changing to effectively thermally conduct absorbed heat through the body to the heat dissipation face, and dissipate effectively thermally conducted heat at the heat dissipation face.

12. An acoustic panel, comprising:

a cellular panel that forms cells;

an acoustic unit whose construction is based on a cell, the acoustic unit including the cell and an acoustic element attached across the cell under a fixed boundary condition therewith, whereby the acoustic unit is configured to attenuate the movement of frontal acoustic excitation using the acoustic element, and made at least partially from a thermally nonconductive material; and a vapor chamber attached across a cell under a fixed boundary condition therewith, the vapor chamber having a body with an exterior heat absorption face and an opposing exterior heat dissipation face, the vapor chamber configured to help move heat past the cell by absorbing heat at the heat absorption face, employing vapor-liquid phase changing to effectively thermally conduct absorbed heat through the body to the heat dissipation face, and dissipating effectively thermally conducted heat at the heat dissipation face.

13. The acoustic panel of claim 12, wherein the cell on which the construction of the acoustic unit is based and the cell across which the vapor chamber is attached are the same cell, and the vapor chamber is the acoustic element, whereby the acoustic unit is configured to attenuate the movement of frontal acoustic excitation using the vapor chamber.

14. An acoustic unit, comprising:

an acoustically septumized cell; and a vapor chamber attached across the cell under a fixed boundary condition therewith; wherein in relation to the vapor chamber, the remainder of the acoustic unit is made at least partially from a thermally nonconductive material, and the vapor chamber is configured to employ vapor-liquid phase changing to help move heat past the cell; and the acoustic unit has a frequency target, and the vapor chamber is an acoustic element, whereby the acoustic unit is configured to particularly affect frontal acoustic excitation about the frequency target using the vapor chamber.

15. The acoustic unit of claim 14, wherein the frequency target is a cutoff reflection frequency, and the acoustic unit comprises:

the cell, wherein the cell is made from the thermally nonconductive material; and the vapor chamber attached across the cell as an acoustic septum, whereby the cell is acoustically septumized; wherein the vapor chamber is an anti-vibration plate, whereby the acoustic unit is configured to substantially reflect frontal acoustic excitation below the cutoff reflection frequency using the vapor chamber.

16. The acoustic unit of claim 15, wherein the vapor chamber is attached across the cell at a depth, and the cell is configured to rectify diffused frontal acoustic excitation into normal frontal acoustic excitation.

17. The acoustic unit of claim 14, wherein the frequency target is a peak absorption frequency, and the acoustic unit comprises:

the cell, wherein the cell is made from a thermally conductive material;

an acoustic septum attached across the cell under a fixed boundary condition therewith, whereby the cell is acoustically septumized, wherein the acoustic septum is made from the thermally nonconductive material; and the vapor chamber attached across the cell behind the acoustic septum as an acoustic backing; wherein the acoustic septum is a vibratory membrane and the vapor chamber is an anti-vibration back plate, whereby the acoustic unit is configured to substantially non-propagatively absorb frontal acoustic excitation at the peak absorption frequency using the acoustic septum and the vapor chamber.

18. The acoustic unit of claim 17, wherein the acoustic septum is attached across the cell at a depth, and the cell is configured to rectify diffused frontal acoustic excitation into normal frontal acoustic excitation.

19. The acoustic unit of claim 14, wherein the vapor chamber has a body with an exterior heat absorption face and an opposing exterior heat dissipation face, and to help move heat past the cell, the vapor chamber is configured to absorb heat at the heat absorption face, employ vapor-liquid phase changing to effectively thermally conduct absorbed heat through the body to the heat dissipation face, and dissipate effectively thermally conducted heat at the heat dissipation face.

* * * * *